US009205899B2

(12) United States Patent
Yu et al.

(10) Patent No.: US 9,205,899 B2
(45) Date of Patent: Dec. 8, 2015

(54) ELECTROMAGNETIC MARINE FENDER

(71) Applicant: Dalian University of Technology, Dalian (CN)

(72) Inventors: Yanyun Yu, Dalian (CN); Yan Lin, Dalian (CN); Ming Chen, Dalian (CN); Yunlong Wang, Dalian (CN); Kai Li, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 0 days.

(21) Appl. No.: 14/676,779

(22) Filed: Apr. 1, 2015

(65) Prior Publication Data

US 2015/0203179 A1 Jul. 23, 2015

Related U.S. Application Data

(63) Continuation-in-part of application No. PCT/CN2014/000379, filed on Apr. 8, 2014.

(30) Foreign Application Priority Data

May 2, 2013 (CN) ..... 2013 1 0155374

(51) Int. Cl.

| | |
|---|---|
| ***B63B 59/02*** | (2006.01) |
| ***H01F 7/20*** | (2006.01) |
| *H01F 7/06* | (2006.01) |

(52) U.S. Cl.

CPC ..... *B63B 59/02* (2013.01); *H01F 7/202* (2013.01); *B63B 2059/025* (2013.01); *B63B 2231/30* (2013.01); *H01F 2007/062* (2013.01)

(58) Field of Classification Search

CPC ..... B63B 59/02; H01F 7/202

See application file for complete search history.

(56) References Cited

U.S. PATENT DOCUMENTS

| | | | | |
|---|---|---|---|---|
| 4,010,858 | A * | 3/1977 | Mahnke, Jr. | B60S 9/22 267/140 |
| 4,030,441 | A * | 6/1977 | Nagata | B63B 21/56 114/242 |
| 4,054,476 | A * | 10/1977 | Hara | E02B 3/26 114/219 |
| 2015/0203179 | A1 * | 7/2015 | Yu | B63B 59/02 114/219 |

* cited by examiner

*Primary Examiner* — S. Joseph Morano
*Assistant Examiner* — Jovon Hayes
(74) *Attorney, Agent, or Firm* — Matthias Scholl, PC; Matthias Scholl

(57) ABSTRACT

An electromagnetic marine fender, including: a rubber fender, two electromagnet groups, tensile steel ropes, an electric cable, and a waterproof power socket. Each electromagnet group includes at least one electromagnet. The electromagnet coils of the electromagnets have the same winding direction. The two electromagnet groups are disposed on two sides of the rubber fender, and the two electromagnet groups and the rubber fender are connected and fixed as a whole by the tensile steel ropes. The electromagnet is a combination structure including an electromagnet core, an electromagnet coil, an electromagnet steel shell, and a rubber coating covering the electromagnet steel shell from the center outward. The electromagnet coils of the electromagnets of the two electromagnet groups are connected in parallel, and the two electromagnet groups are in electric connection to the waterproof power socket via the electric cable.

3 Claims, 4 Drawing Sheets

ELECTROMAGNETIC MARINE FENDER

CROSS-REFERENCE TO RELATED APPLICATIONS

This application is a continuation-in-part of International Patent Application No. PCT/CN2014/000379 with an international filing date of Apr. 8, 2014, designating the United States, now pending, and further claims priority benefits to Chinese Patent Application No. 201310155374.6 filed May 2, 2013. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND OF THE INVENTION

1. Field of the Invention

The invention relates to an electromagnetic marine fender.

2. Description of the Related Art

A typical method for ship-ship berthing at sea is mooring one ship to another. However, such a method is restricted by many factors and has poor security. First, when the height difference between the decks of the two ships and the water level is too large, the mooring cables and the cable guide holes are easily damaged, and transverse movements still exist after the mooring. In addition, under the action of periodical dynamic load, the two ships may collide with each other. Second, the mooring device is restricted by the longitudinal positions of the cable guide holes. When the space between the longitudinal positions of one pair of the cable guide holes of two ships is too large, the pulling force of the cable is primarily exerted on the cable guide holes, thus resulting in loose anchoring. Third, the two ships are fixed at the decks during mooring, which forms a hinge-like structure. In case of relatively large waves, the transverse rotation of the two ships often causes collisions between the upper constructions and the masts, which is very dangerous.

SUMMARY OF THE INVENTION

In view of the above-described problems, it is one objective of the invention to provide an electromagnetic marine fender that is adapted to prevent two ships from separation or rigid collision. The electromagnetic marine fender provides effective means for safe and fast ship-ship berthing.

To achieve the above objective, in accordance with one embodiment of the invention, there is provided an electromagnetic marine fender comprising: a rubber fender, two electromagnet groups, tensile steel ropes, an electric cable, and a waterproof power socket. Each electromagnet group comprises at least one electromagnet. Each electromagnet comprises: an electromagnet core, an electromagnet coil, an electromagnet steel shell, and a rubber coating covering the electromagnet steel shell. The electromagnet coils of the electromagnets have the same winding direction. The two electromagnet groups are disposed on two sides of the rubber fender, and the two electromagnet groups and the rubber fender are connected and fixed as a whole by the tensile steel ropes. The electromagnet is a combination structure comprising the electromagnet core, the electromagnet coil, the electromagnet steel shell, and the rubber coating covering the electromagnet steel shell from the center outward. The electromagnet coils of the electromagnets of the two electromagnet groups are connected in parallel, and the two electromagnet groups are in electric connection to the waterproof power socket via the electric cable.

In a class of this embodiment, the rubber fender comprises a pneumatic valve. The rubber fender is made of a rubber composite material.

In a class of this embodiment, when the electromagnet group is electrified, each electromagnet has the same pole direction, the electromagnetic marine fender operates as a combined electromagnet providing a magnetic force sufficient to attract steel plates of sides of two ships, and the two sides of the fender function as an N pole and an S pole of the combined electromagnet, respectively.

In accordance with another embodiment of the invention, there is provided a method for using the electromagnetic marine fender. A gravity of the whole electromagnetic marine fender is larger than a floating force thereof. During work, a position of the electromagnetic marine fender is regulated in a direction of a molded depth of the ship by controlling steel ropes passing through hanging rings whereby mooring two ships together at a proper position in a vertical direction.

In the above technical solution, the electromagnet steel shell functions not only in protecting the electromagnet coil and the electromagnet core but also as a force transmission components for transferring a load from an outer plate of a ship hull to the fender. Hanging rings are arranged on tops of the electromagnet steel shells arranged on two sides of the electromagnet marine fender for the purpose of pulling back the electromagnet marine fender and placing the electromagnet marine fender on a deck of the ship. Lower ends of the electromagnet steel shells are designed to be beneath a bottom plane of the rubber fender, so that the electromagnet steel shells also work as a support when in a spare state placed on the deck. A surface of an outer side of each electromagnet steel shell is coated with a thin layer of a rubber so as to avoid damaging a hull coating during contact. Besides, the rubber material is adapted to increase a frictional coefficient between the magnet and the outer board of the ship hull, thereby preventing the fender from slipping on the hull surface. Upper ends and lower ends of each pair of the electromagnets (on two opposite sides) of the electromagnet marine fender are provided with tensile steel ropes. The tensile steel ropes are in relaxed states when the fender is free from external forces or pressures. When the fender is uniformly pulled because of transverse separation of the two ships or when the fender is non-uniformly unilaterally pulled because of inconsistent shakings in the transverse direction or the longitudinal direction, or in the front ends of the two ships, the tensile steel ropes of the pulling positions become the main force components, thereby functioning in preventing the pulling force from damaging the electromagnetic marine fender.

Advantages according to embodiments of the invention are summarized as follows:

The two sides of the rubber fender of the electromagnetic marine fender are provided with electromagnet groups. Each electromagnet group comprises at least one electromagnet comprising coils with the same winding direction. The electromagnet is the combination structure comprising the electromagnet core, the electromagnet coil, the electromagnet steel shell, and the rubber coating covering the electromagnet steel shell. The electromagnet coils of all the electromagnets are connected in parallel, and the two electromagnet groups are connected to the waterproof power socket via the electric cable for realizing electric connection. The electromagnetic marine fender is a ship-ship berthing device to solve problems that the conventional ship-ship berthing method imposes high requirements on the ship types and sea conditions and has poor safety and complicated operations. The device of the invention possesses both the functions of the berthing device and the conventional marine fender, that is, the device of the invention is capable of fixing two ships together as well as preventing hull damages resulting from direct collision of the two ships. The device of the invention can be used alone or in a combination. An ideal use method of the device is that placing four electromagnetic marine fenders in two rows in two columns and allowing a column spacing and a row spacing as large as possible, so that the combined devices are capable of effectively resisting the relative movements of the two ships in the transverse directions, the longitudinal directions, and the perpendicular directions, as well as resisting the relative rotation in the transverse direction, the longitudinal direction, and the front ends of the ships. The device is adapted to decrease the limitations on the ship types and the environment in the ship-ship berthing and to effectively improve the safeness of the ships.

BRIEF DESCRIPTION OF THE DRAWINGS

The invention is described hereinbelow with reference to the accompanying drawings, in which.

Figure 1:
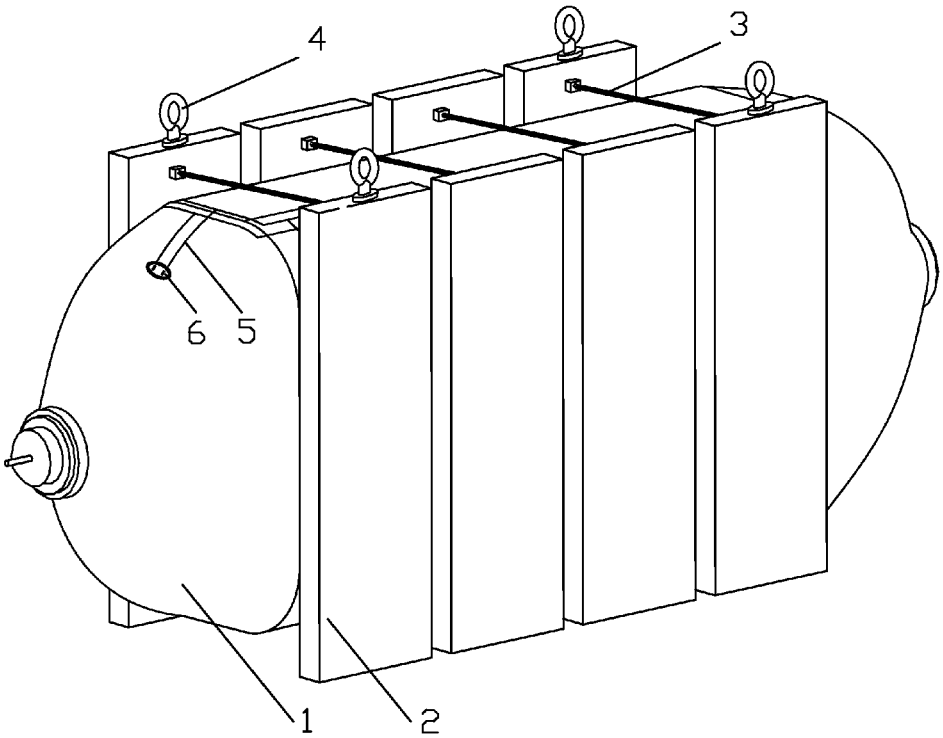
FIG. 1 is a structure diagram of an electromagnet marine fender in accordance with one embodiment of the invention.
Figure 2:
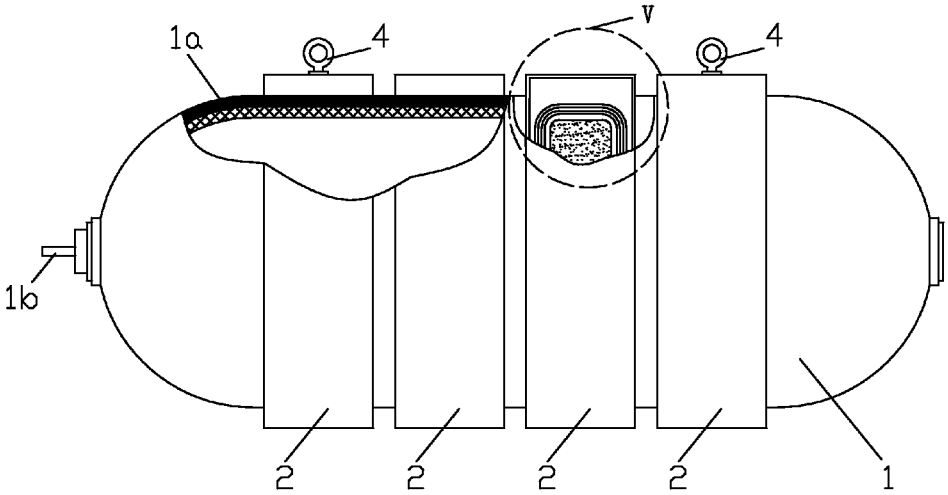
FIG. 2 is a front view of an electromagnet marine fender in accordance with one embodiment of the invention.

In the drawings, the following reference numbers are used: 1. Rubber fender; 1*a*. Rubber composite material; 1*b*. Pneumatic valve of fender; 2. Electromagnet; 2*a*. Electromagnet coil; 2*b*. Electromagnet core; 2*c*. Electromagnet steel shell; 2*d*. Rubber coating covering electromagnet steel shell; 3. Tensile steel rope; 4. Hanging ring; 5. Electric cable; and 6. Waterproof power socket.

DETAILED DESCRIPTION OF THE EMBODIMENTS

For further illustrating the invention, experiments detailing an electromagnet marine fender are described below. It should be noted that the following examples are intended to describe and not to limit the invention.

Overall structures of an electromagnet marine fender are illustrated in FIGS. 1-7. The electromagnet marine fender comprises a rubber fender 1 and two electromagnet groups. Each electromagnet group adopts four magnets comprising coils winded in the same direction. The electromagnet groups are disposed on two sides of the rubber fender 1. The rubber fender 1 and the electromagnet groups arranged on the two sides thereof are fixed and connected together as a whole by tensile steel ropes 3. The electromagnet 2 is a combination structure comprising an electromagnet core 2*b*, an electromagnet coil 2*a*, an electromagnet steel shell 2*c*, and a rubber coating 2*d* covering the electromagnet steel shell 2*c* from the center outward. When the electromagnet coils 2*a* of all the electromagnets 2 of the two electromagnet groups are connected in parallel, the two electromagnet groups are in electric connection to a waterproof power socket 6 via an electric cable 5. The rubber fender is provided with a pneumatic valve and is made of a rubber composite material. When the electromagnet groups are electrified, each electromagnet 2 has the same pole direction, the electromagnetic marine fender operates as a combined electromagnet providing a magnetic force sufficient to attract steel plates of sides of two ships, and the two sides of the fender function as an N pole and an S pole of the combined electromagnet, respectively. A gravity of the whole electromagnetic marine fender is larger than a floating force thereof. During work, a position of the electromagnetic marine fender is regulated in a direction of a molded depth of the ship by controlling steel ropes passing through hanging rings 4, so that ships are moored together at a proper position in a vertical direction.

Figure 3:
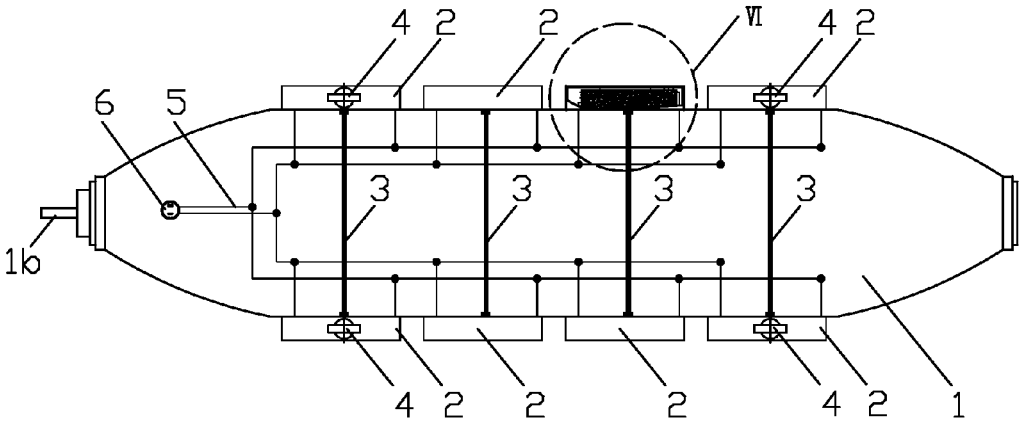
FIG. 3 is a top view of an electromagnet marine fender in accordance with one embodiment of the invention.
Figure 4:
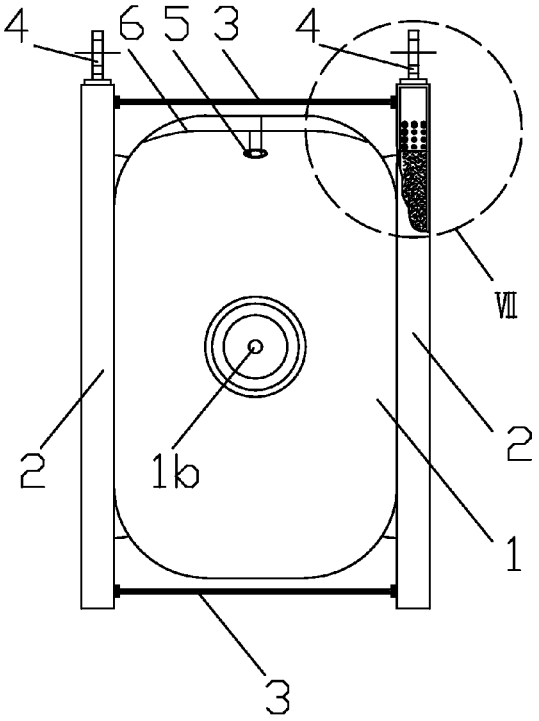
FIG. 4 is a side view of an electromagnet marine fender in accordance with one embodiment of the invention.

As shown in FIGS. 1-4, the rubber fender 1 of the electromagnet marine fender has two planar sides where the two groups of the electromagnets 2 are arranged. Contact surfaces between the electromagnets 2 and the rubber fender are rough surfaces, and the rubber fender 1 and the electromagnets 2 are fixed together by hot-melt or by adhesives. A force exerted on the electromagnets 2 from an outer plate of a ship hull is directly transmitted to the rubber fender 1 via an inner surface. Upper ends and lower ends of inner sides of the electromagnets of opposite sides are connected via the tensile steel ropes 3. Pulling forces exerted on the electromagnets 2 from the outer plate of the ship hull is directly transmitted from the electromagnets 2 of one side to the ones of the opposite side via the tensile steel ropes 3, that is, the rubber fender 1 does not bear any pulling forces. As shown in FIG. 3, the electromagnet coils 2*a* of all the electromagnets 2 are in electric connection in parallel. The electric cable 5 is disposed on an upper surface of the rubber fender 1. And a positive bus and a negative bus are gathered and then connected to the waterproof power socket 6.

Figure 5:
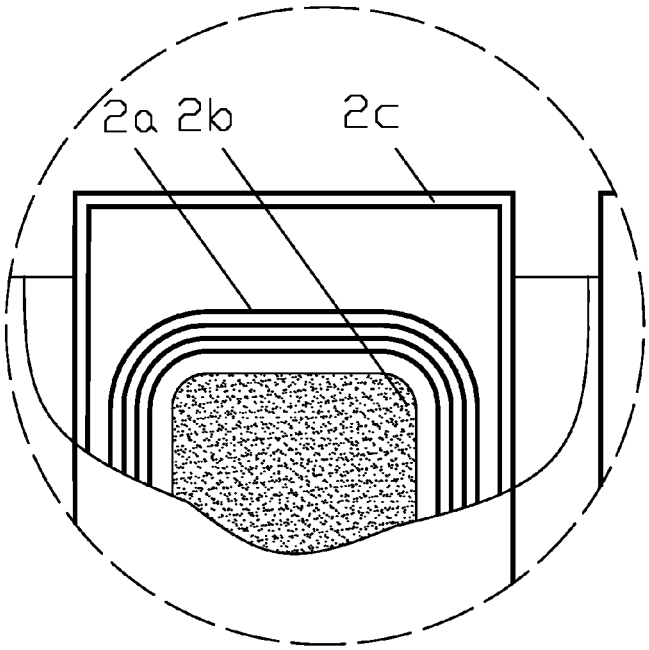
FIG. 5 is an enlarged view of part V of FIG. 2.
Figure 6:
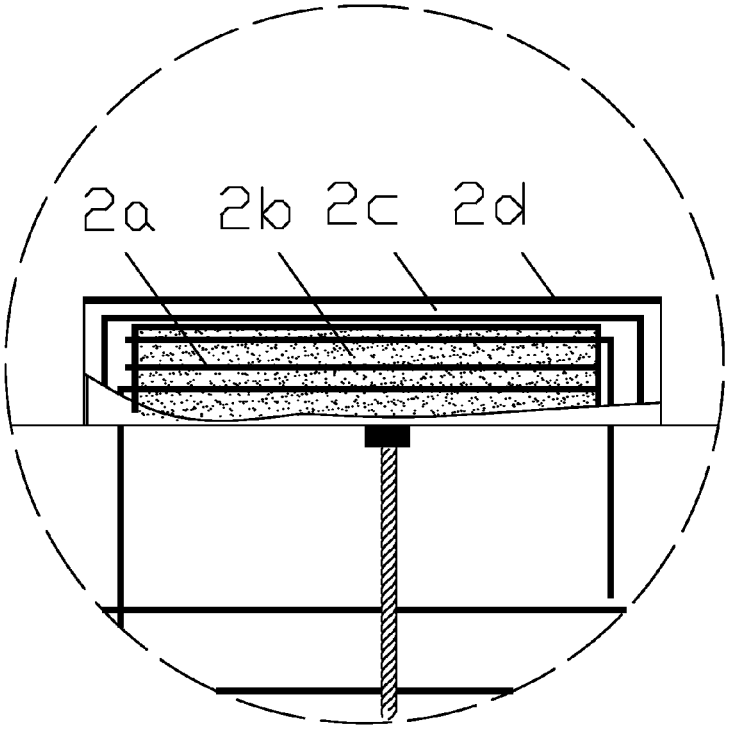
FIG. 6 is an enlarged view of part VI of FIG. 3.
Figure 7:
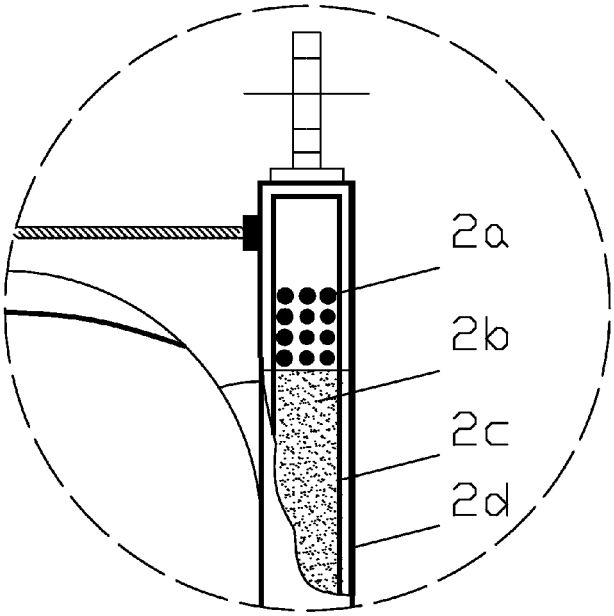
FIG. 7 is an enlarged view of part VII of FIG. 4.

As shown in FIGS. 5-7, each electromagnet 2 is formed by the electromagnet core 2*b* in a square shape, the electromagnet coil 2*a*, the electromagnet steel shell 2*c*, and the rubber coating 2*d* covering the electromagnet steel shell. An axis of each electromagnet coil 2*a* is in parallel to a horizontal plane and perpendicular to an axis of the rubber fender 1. The electromagnets 2 after being electrified have the same pole directions.

Figure 8:
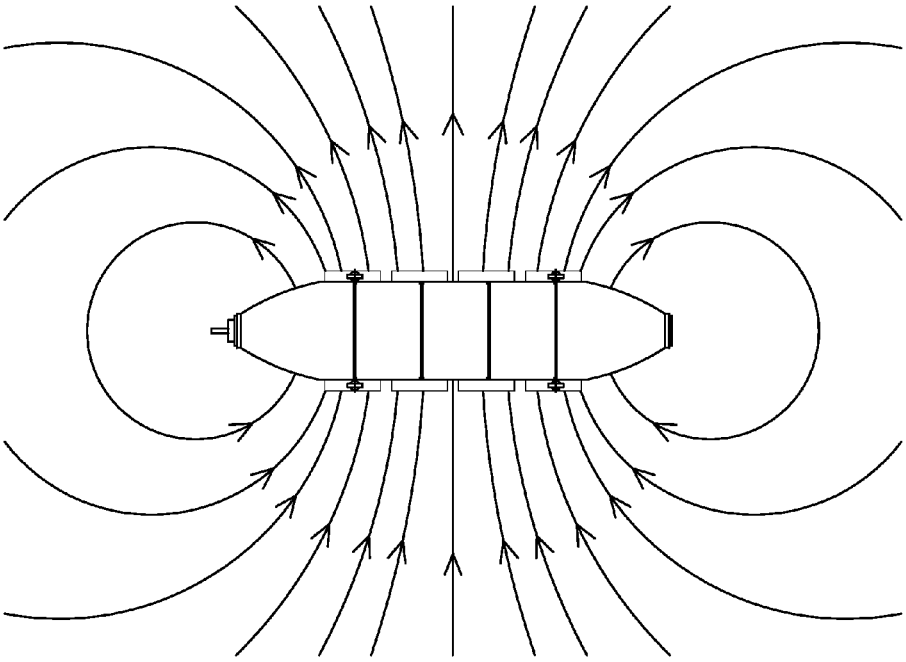
FIG. 8 is a picture showing magnetic field distribution of an electromagnet marine fender in working condition.

To use the electromagnet marine fender, a DC plug is inserted into the waterproof power socket 6, and the electromagnet fender is hanged by a hanging rack, moved outside the ship, and placed into the seawater at a preset position. A power switch of the electromagnet is then opened so that electric fields are superimposed and the electromagnet marine fender forms a large combined electromagnet and the magnetic field distribution thereof is illustrated in FIG. 8. An attractive force produced by the combined electromagnet enables the fender to be sucked on the side of the ship hull. Two ships gradually approach by propellers, lateral thruster systems, or mooring fittings thereof, and the current of the combined electromagnet is increased when the two ships are close enough, so that the two ships are pulled together by the attraction force, and the other side of the electromagnet marine fender is attached to one side of the other ship hull, thereby accomplishing the ship-ship berthing. After the berthing operation, the power switch of the electromagnet is turned off, so that the electromagnet is separated from the outer plates of the ship hulls in the absence of the magnetic force, and thereafter, the electromagnet marine fender is pulled back to enable the two ships be free from the berthing.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An electromagnetic marine fender, comprising:

a) a rubber fender;

b) two electromagnet groups, each electromagnet group comprising at least one electromagnet; each electromagnet comprising: an electromagnet core, an electromagnet coil, an electromagnet steel shell, and a rubber coating covering the electromagnet steel shell;

c) tensile steel ropes;

d) an electric cable; and e) a waterproof power socket;

wherein the electromagnet coils of the electromagnets of the two electromagnet groups have the same winding direction;

the two electromagnet groups are disposed on two sides of the rubber fender, and the two electromagnet groups and the rubber fender are connected and fixed as a whole by the tensile steel ropes;

the electromagnet is a combination structure comprising the electromagnet core, the electromagnet coil, the electromagnet steel shell, and the rubber coating covering the electromagnet steel shell from the center outward; and the electromagnet coils of the electromagnets of the two electromagnet groups are connected in parallel, and the two electromagnet groups are in electric connection to the waterproof power socket via the electric cable.

2. The electromagnetic marine fender of claim 1, wherein the rubber fender comprises a pneumatic valve and is made of a rubber composite material.

3. The electromagnetic marine fender of claim 1, wherein when the electromagnet group is electrified, the electromagnets have the same pole directions, the electromagnetic marine fender operates as a combined electromagnet providing a magnetic force to attract steel plates of both sides of two ships, and the two sides of the fender function as an N pole and an S pole of the combined electromagnet, respectively.

* * * * *